US011469509B2

(12) United States Patent
Globisch et al.

(10) Patent No.: US 11,469,509 B2
(45) Date of Patent: Oct. 11, 2022

(54) TERAHERTZ TRANSCEIVERS

(71) Applicant: FRAUNHOFER-GESELLSCHAFT ZUR FÖRDERUNG DER ANGEWANDTEN FORSCHUNG E.V., Munich (DE)

(72) Inventors: Björn Globisch, Berlin (DE); Roman J. B. Dietz, Berlin (DE); Thorsten Göbel, Frankfurt (DE)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 687 days.

(21) Appl. No.: 16/331,106

(22) PCT Filed: Sep. 23, 2016

(86) PCT No.: PCT/EP2016/072775
§ 371 (c)(1),
(2) Date: Mar. 6, 2019

(87) PCT Pub. No.: WO2018/046111
PCT Pub. Date: Mar. 15, 2018

(65) Prior Publication Data

US 2021/0336346 A1 Oct. 28, 2021

(30) Foreign Application Priority Data

Sep. 7, 2016 (DE) ..... 10 2016 217 023.6

(51) Int. Cl.
*H01Q 9/28* (2006.01)
*H01Q 1/52* (2006.01)

(52) U.S. Cl.
CPC ..... *H01Q 9/285* (2013.01); *H01Q 1/525* (2013.01)

(58) Field of Classification Search
CPC ..... H01Q 9/065; H01Q 9/265; H01Q 9/44; H01Q 9/285; H01Q 9/16; H01Q 5/48; H01Q 1/525
See application file for complete search history.

(56) References Cited

U.S. PATENT DOCUMENTS 6,844,552 B2 1/2005 Zhang et al.
2004/0227683 A1* 11/2004 Caimi ..... H01Q 9/40 343/742

(Continued)

FOREIGN PATENT DOCUMENTS

EP 2803960 A1 11/2014
JP 2012047595 A 3/2012

(Continued)

OTHER PUBLICATIONS

Zhang et al. "Terahertz pulse generation and detection with LT-GaAs photoconductive antenna." IEE Proceedings: Optoelectronics, Institution of Electrical Engineers, vol. 151, No. 2 (Apr. 2004) 98-101.

(Continued)

*Primary Examiner* — Awat M Salih
(74) *Attorney, Agent, or Firm* — Maschoff Brennan

(57) ABSTRACT

A terahertz transceiver, comprising at least a first and a second antenna, wherein the first and/or the second antenna is a dipole antenna comprising a dipole section, wherein the dipole section has a gap through which light can be radiated onto the photoconductive material, and wherein a first ending of the dipole section is connected to a first feedline and a second ending of the dipole section is connected to a second feedline, the feedlines (extending with an angle to the dipole section. The first and/or the second antenna has an asymmetric design, wherein a first section of at least one of the feedlines extending on one side of the dipole section is longer than a second section of the at least one feedline (Continued)

extending on the other side of the dipole section and/or at least one of the feedlines extends on one side of the dipole section, only.

14 Claims, 4 Drawing Sheets

(56) References Cited

U.S. PATENT DOCUMENTS

| | | | | |
|---|---|---|---|---|
| 2006/0152412 | A1* | 7/2006 | Evans | H01L 31/0224 343/700 MS |
| 2010/0134372 | A1* | 6/2010 | Ryu | H01Q 9/26 343/793 |
| 2010/0230596 | A1 | 9/2010 | Kuroyanagi et al. | |
| 2013/0306869 | A1 | 11/2013 | Sartorius et al. | |
| 2014/0252379 | A1* | 9/2014 | Sato | H01L 21/02463 257/85 |
| 2021/0057594 | A1* | 2/2021 | Nguyen | H01L 31/0392 |

FOREIGN PATENT DOCUMENTS

| | | | |
|---|---|---|---|
| JP | 2013540273 | A | 10/2013 |
| JP | 2014197669 | A | 10/2014 |
| JP | 2016111219 | A | 6/2016 |
| WO | 2007/006552 | A1 | 7/2006 |
| WO | 2009063733 | A | 5/2009 |

OTHER PUBLICATIONS

European Search Report in Application No. 16 774 901.9 dated Aug. 18, 2020.

JP Decision to Grant Application No. 2019-533279 dated Mar. 24, 2020.

Bark Hyeon Sang et al., "Optical fiber coupled THz transceiver", 40th International Conference on Infrared, Millimeter, and Terahertz Waves, IEEE, Aug. 23, 2015.

Busch et al., Terahertz transceiver concept, Optics Express, vol. 22, No. 14 (2014) 16841-16846.

Jördens et al., Fibre-coupled terahertz transceiver head, Electronics Letters, vol. 44, No. 25, Dec. 4, 2008, 2 pages.

Tani et al., Photoconductive terahertz transceiver, Electronics Letters, vol. 36, No. 9, Apr. 27, 2000, 2 pages.

Tani et al., Photoconductive twin dipole antennas for THz transceiver, Electronics Letters, vol. 38, No. 1, Jan. 3, 2002, 2 pages.

* cited by examiner

TERAHERTZ TRANSCEIVERS

CROSS-REFERENCE TO A RELATED APPLICATION

This application is a National Phase Patent Application of International Patent Application Number PCT/EP2016/072775, filed on Sep. 23, 2016, which claims priority of German Patent Application 10 2016 217 023.6, filed on Sep. 7, 2016.

BACKGROUND

The disclosure relates to terahertz transceivers.

Terahertz systems, i.e. systems radiating electromagnetic radiation e.g. in the region between 0.1 to 10 THz, have become compact and stable measurement systems not only for research, but also for industrial applications. These systems, for example, comprise photoconductive terahertz antennas (PCAs), i.e. antenna structures arranged on a photoconductor (usually comprising several photoconductive layers), the photoconductive layers of a terahertz transmitter or receiver having e.g. recombination times below 1 ps. In a terahertz transmitter, light pulses of a pulsed laser (e.g. a picosecond or a femtosecond laser) generate a temporary, ultrashort conductivity of the photoconductive layers, which, upon applying an external voltage, create corresponding short and intense current pulses. These current pulses, i.e. accelerated charge carriers, radiate electromagnetic waves in the terahertz frequency region.

In a terahertz receiver, electromagnetic terahertz pulses induce voltages in the photoconductor, which create a current only when a femtosecond light pulse (probe pulse) generates conductivity within the photoconductive layers simultaneously. By means of a temporal offset between the received terahertz pulses and the optical probe pulse, the terahertz signal emitted by the terahertz transmitter can be detected coherently, i.e. a signal including both amplitude and phase information can be produced. By means of a Fourier transform of the measured terahertz radiation a frequency spectrum could be derived.

In the last years, terahertz systems with stationary lasers and fiber-coupled, movable transmitter and receiver modules have become a standard in THz spectroscopy. However, many industrial applications in fields like non-destructive testing and in-line process monitoring permit only one-side access to the sample under test. Thus, measurements in reflection geometry are required, in which the emitted THz radiation is reflected from the sample surface into the direction of the transmitter or in close proximity to it. THz reflection measurements with the use of discrete transmitter and detector devices commonly require several optical elements, which are costly and increase the complexity of the set-up. Furthermore, measurements in nearly normal incidence would allow for the use of the same optical elements for the transmitted and the reflected THz beam which enabled measurements through small observation windows. Therefore, an arrangement comprising a terahertz transmitter and a terahertz receiver in close proximity is required.

A terahertz transceiver, i.e. an arrangement comprising a terahertz transmitter and a terahertz receiver, is disclosed for example in the article H. S. Bark, Y. B. Ji, S. J. Oh, S. K. Noh, T. I. Jeon, "Optical fiber coupled THz transceiver", Proc. 40th International Conference on Infrared Millimeter, and Terahertz Waves (IRMMW-THz), 2015. Both the terahertz transmitter and the receiver comprises photoconductive antennas having the shape of an "H", i.e. an antenna having two vertical feedlines connecting to a horizontal dipole section (which forms the actual antenna). Due to the symmetric, H-shaped configuration the radiation originating from currents with opposite directions cancels out in the far field perpendicular to the antenna plane. Furthermore, feedlines with a length of several mm are preferred since reflections at the line ends may be shifted out of the measuring window. The antennas are arranged adjacent to one another in a direction perpendicular to the feedlines. The transmitting antenna is used for radiating terahertz radiation onto an object, while the receiving antenna is used for detecting terahertz radiation reflected by the object. The PCAs are mounted on a silicon lens in order to couple the terahertz radiation into free space and vice versa, wherein the same optics are used for the forward and backward terahertz beam. Thus, the antennas have to be arranged as close to one another as possible. Such an arrangement, however, creates crosstalk between the two antennas (especially crosstalk with respect to the terahertz radiation and/or induced by electrical currents in the antennas). For separating the antenna signals a mechanical chopper is used and the antenna signals are detected using the lock-in technique. However, even using the lock-in technique, the signal quality often is not satisfying.

SUMMARY

The object underlying the proposed solution is to reduce crosstalk between the transmitter and the receiver antenna of a terahertz transceiver.

According to the solution, a terahertz transceiver is provided, comprising

- at least a first and a second antenna, wherein
- the first and/or the second antenna is a dipole antenna comprising a dipole section, wherein
- the dipole section has a gap through which light can be radiated onto a photoconductive material, wherein
- a first ending of the dipole section is connected to a first feedline and a second ending of the dipole section is connected to a second feedline, the feedlines extending with an angle (e.g. perpendicular) to the dipole section, and wherein
- the first and/or the second antenna has an asymmetric design, wherein a first section of at least one of the feedlines extending on one side of the dipole section is longer than a second section of the at least one feedline extending on the other side of the dipole section and/or at least one of the feedlines extends on one side of the dipole section, only.

Thus, the first and the second (photoconductive) antenna, respectively, do not have the conventional H shape. Rather, the section of the feedline (or the sections of two feedlines) on one side of the horizontal dipole section is shorter than the section of the feedline on the other side of the dipole section or the antenna comprises a feedline (or e.g. two feedlines) extending on one side of the dipole section, only (such that a U-shaped antenna may be created rather than an H-shaped antenna). For example, the length of the first section is at least twice, at least three times or at least five times the length of the second section of the at least one feedline. It is noted that the first and the second section of the antenna(s) extend on different sides of the dipole section opposite to one another in a direction perpendicular to the dipole section. The dipole section may comprise (or may consist of) a first and a second electrically conductive material (e.g. metallic and/or strip-like) portion adjoining the gap.

The asymmetric antenna design may differ from the conventional rules applied for optimizing single antennas. However, the deviation from the optimizing design rules allows to reduce crosstalk between closely neighbored antennas such that the deviations from the conventional optimizing design rules become acceptable. Using the asymmetric antenna design for at least one of the two antennas permits to arrange the antennas in close proximity in order to be able to use the same optics for transmitting and receiving terahertz radiation, wherein the crosstalk between the antennas is reduced. Further, smaller optics may be used and because of the reduced crosstalk, terahertz radiation may be detected quickly and e.g. without having to use a lock-in set-up. The antennas may be realized by an electrically conductive (e.g. metallic) structure electrically connected to the photoconductive material. For example, the first and second portion of the dipole section is connected to the photoconductive material, wherein the first and second portion of the dipole section may laterally adjoin the photoconductive material and/or may be at least partially arranged on the photoconductive material.

For example, both the first and the second antenna has an asymmetric design, wherein the antennas are arranged in such a way that the longer section of the feedline or the entire feed line of the first antenna is directed in the opposite direction of the longer section of the feedline or the entire feed line of the second antenna. In other words, the feedlines of the antennas point in opposite directions such that the antennas may be arranged offset in a direction parallel to the antenna's feedlines, e.g. at least partially one below the other, such that the excitation points of the antennas can be approached to one another as close as possible without creating a shortcut between the antenna arms of the two antennas and maintaining a certain distance between the feedlines, thereby reducing crosstalk between them. In particular, the first and the second antenna might be at least partially arranged in a row extending parallel to the feedlines (perpendicular to the antenna's dipole sections); e.g. at least partially one below the other as already mentioned above.

The solution is further related to a terahertz transceiver comprising a first and/or second antenna, wherein the first and/or the second antenna is a terahertz stripline antenna consisting of two parallel striplines only, the striplines electrically connecting a photoconductive material. For example, the striplines are at least partially arranged on the photoconductive material and/or laterally adjoin the photoconductive material. That kind of a terahertz antenna may be regarded as being derived from the terahertz dipole antenna described above by enlarging the gap of the dipole section to equal the distance between the feedlines. Thus, the terahertz stripline antenna might be considered as a modified terahertz dipole antenna, wherein the dipole section is provided by the photoconductive material between the feedlines only.

It is of course possible that only one of the two antennas is a stripline antenna, while the other antenna is a different antenna type, in particular a dipole antenna as described above.

One of the antennas of the terahertz transceiver may be a transmitting antenna while the other antenna is a receiving antenna.

The first and the second antenna might be monolithically integrated on a common substrate (for example an indium phosphide substrate).

Moreover, the distances between an excitation region of the first antenna and an excitation region of the second antenna is smaller than 100 μm, 50 μm or 25 μm.

The solution is also related to a terahertz transceiver, in particular configured as described above, comprising a first and/or a second antenna, wherein the terahertz transceiver comprises a coupling element configured for coupling light from a first optical fiber onto an excitation region of the first antenna and for coupling light from a second optical fiber onto an excitation region of the second antenna.

For example, the coupling element comprises a first integrated optical waveguide for guiding light from the first optical fiber towards the excitation region of the first antenna and a second integrated optical waveguide for guiding light from the second optical fiber towards the excitation region of the second antenna. The coupling element may be realized using a waveguide chip (e.g. a SOI or polymer chip).

Further, the coupling element may be mounted in such a way that its position relative to the excitation points of the first and the second antenna is at least essentially constant. For example, the coupling element is fixed to the antennas and/or to a substrate on which the antennas are arranged, e.g. using an adhesive.

The terahertz transceiver may further comprise an optical arrangement for both imaging terahertz radiation emitted by one of the antennas onto an object and for imaging terahertz radiation reflected back at the object onto the other antenna. In particular, the optical arrangement comprises at least one lens, e.g. made of silicon. Further, a backside of the antenna substrate may be attached to a (e.g. flat) rear surface of this lens, thereby supporting the coupling of the terahertz radiation into free space and vice versa from free space into the antenna.

Arranging the transmitting and the receiving antenna in close proximity and monolithically integrated on the same substrate (chip), electrical crosstalk originating from currents generated by the transmitter may influence the receiver by means of the common substrate.

According to another embodiment, a region between the first and the second antenna is free of the photoconductive material. This can reduce electrical crosstalk originating from currents generated by the transmitter and potentially influencing the receiver via the common substrate (if the transmitting and the receiving antenna are disposed in close proximity and on the same substrate). For example, the photoconductive material is at least partially removed between the first and the second antenna.

For example, excitation regions of the first and/or the second antenna are formed by a photoconductive mesa structure. This configuration might be used for a dipole antenna as well as for a stripline antenna. It is noted that an "excitation region" of the terahertz dipole antenna is a region of the gap of the dipole section in which the photoconductive material is excited by optical radiation. Regarding the above-mentioned stripline antenna, the excitation region is located between the two striplines.

The photoconductive material comprises e.g. a plurality of epitaxial layers, e.g. consisting of InGaAs, InGaAsP and/or InAlAs (e.g. doped with Be or Fe or another transition element) and for example arranged on an isolating or semi-isolating substrate (such as an indium phosphide substrate).

The solution also relates to a terahertz transceiver arrangement comprising a terahertz transceiver as described above and a light source configured for generating light pulses (e.g. picosecond or femtosecond pulses) or a continuous optical beat signal radiated onto the excitation regions of the first and the second antenna. The generated light pulses or the optical beat signal may have a wavelength between 1000 nm und 1700 nm, between 1250 nm und 1350 nm or between 1500 nm and 1650 nm.

The terahertz transceiver arrangement may further comprise an evaluating arrangement for evaluating signals of one of the antennas operated as a receiving antenna, wherein the evaluating arrangement is configured for evaluating the antenna signals without using the lock-in technique.

Further, the terahertz transceiver arrangement may comprise a transceiver with the coupling element described above, wherein the first and the second optical waveguide are fixed to the coupling element.

BRIEF DESCRIPTION OF THE DRAWINGS

Embodiments of the solution are described hereinafter with reference to the drawings.

DETAILED DESCRIPTION

Figure 1:
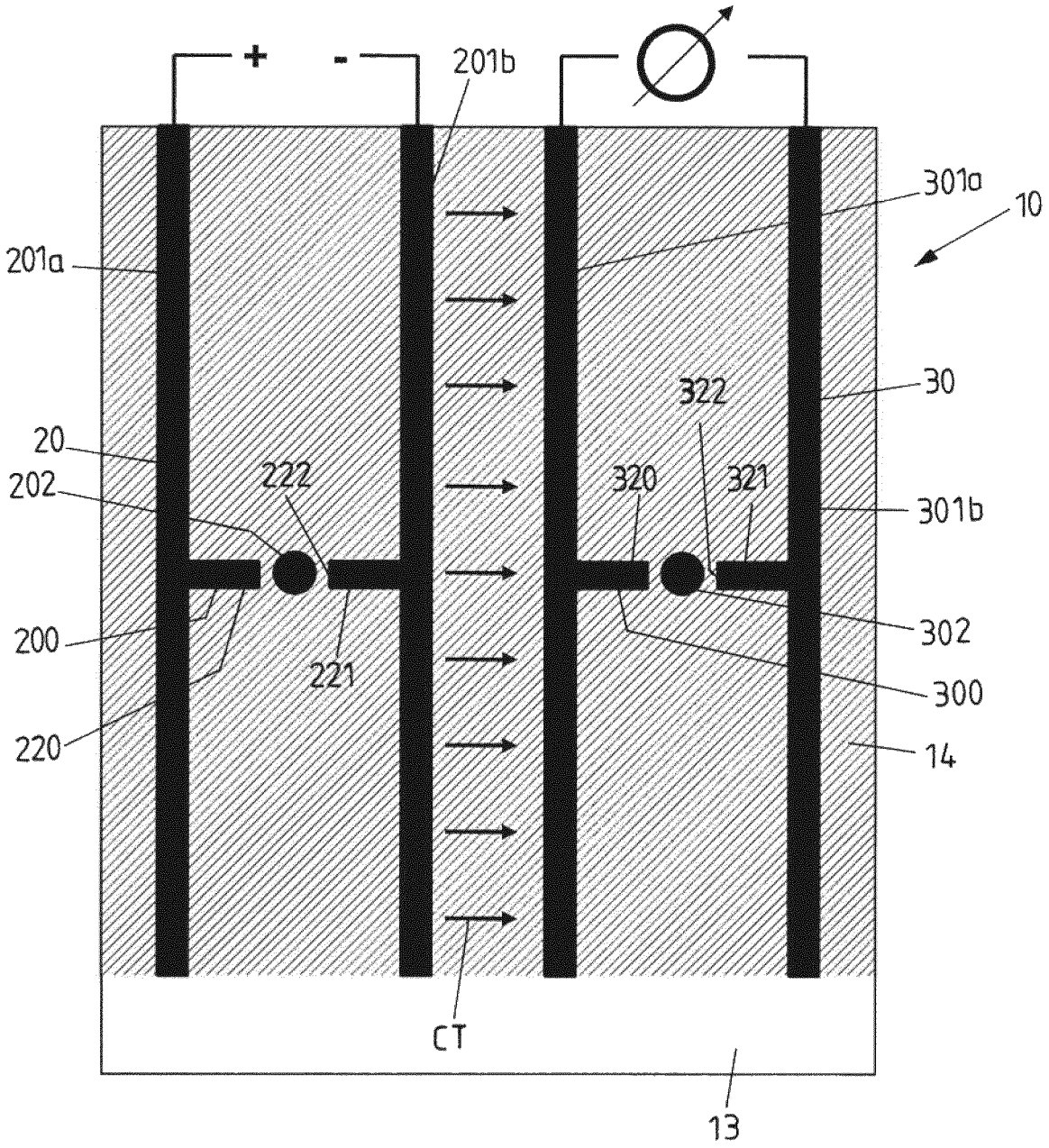
FIG. 1 a top view of a prior art terahertz transceiver.

Prior art transceiver 10 shown in FIG. 1 comprises a first antenna in the form of an H-shaped transmitting antenna 20 and a second antenna in the form of a similarly H-shaped receiving antenna 30. Both the transmitting and the receiving antenna 20, 30 are arranged on photoconductive layers 14, wherein the photoconductive layers 14, in turn, are arranged on a substrate 13. The substrate 13 carries both the transmitting and the receiving antenna 20, 30.

The antennas 20, 30 each comprises a dipole section 200, 300 (orientated horizontally in FIG. 1), the dipole section 200, 300 comprising two metallic strip-like portions 220, 221 and 320, 321, respectively. The strip-like portions 220, 221, 320, 321 adjoin a photoconductive gap 222, 322 of the dipole sections 200, 300.

Moreover, feedlines 201*a*, 201*b* and 301*a*, 301*b* (orientated vertically in FIG. 1) are connected to endings of the metallic portions 220, 221 and 320, 321 of the dipole sections 200, 300 for applying a voltage to the dipole section (transmitting antenna 20) and for detecting a voltage at the dipole section (receiving antenna 30), respectively. The dipole sections 200, 300 may have a length smaller than 100 μm. The feedlines 201*a*, 201*b* and 301*a*, 301*b* extend on both sides of the dipole sections 200, 300, wherein the antennas 20, 30 are arranged close to one another such in order to reduce the distance between excitation regions 202, 302 of the antennas 20, 30. Accordingly, the feedline 201*b* of the transmitting antenna 20 over its entire length—typically several mm—located in close proximity of the feedline 301*a* of the receiving antenna 30, thereby creating considerable crosstalk between the antennas 20, 30 (indicated by arrows CT in FIG. 1).

Figure 2:
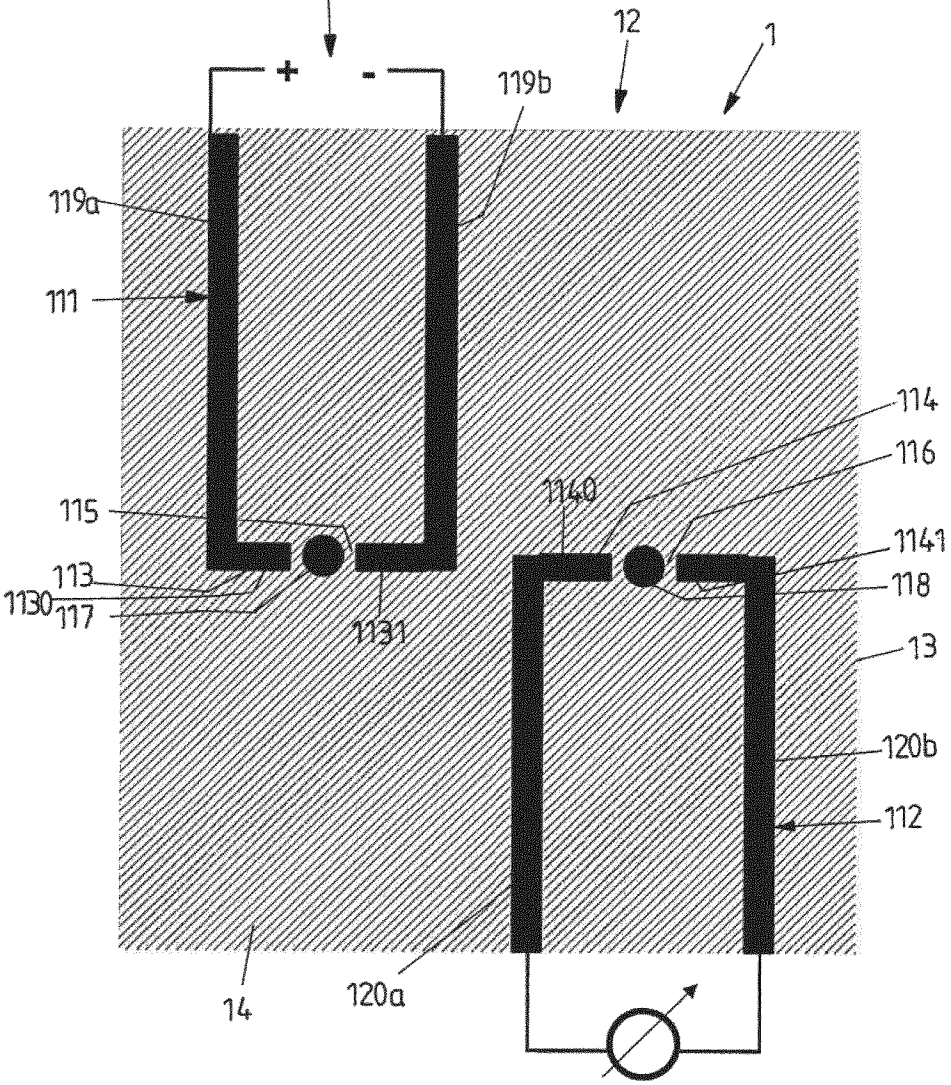
FIG. 2 a terahertz transceiver according to a first embodiment.

FIG. 2 depicts a top view of a terahertz transceiver 1 according to an embodiment. The terahertz transceiver 1 comprises a transmitting section 11 and a receiving section 12. The transmitting section 11 comprises a transmitting antenna 111 and the receiving section 12 comprises a receiving antenna 112, wherein the transmitting and receiving antenna 111, 112 are arranged on a common substrate 13. More particularly, the antennas 111, 112 are arranged on photoconductive layers 14 disposed on the substrate 13.

Each one of the antennas 111, 112 comprises a dipole section 113, 114, wherein the dipole sections 113, 114 include a photoconductive gap 115, 116 defined by two metallic strip-like portions 1130, 1131 and 1140, 1141, respectively. The gaps 115, 116 will be used for radiating optical radiation (such as pulsed optical radiation or a continuous beat signal) onto the photoconductive layers 14, wherein the radiated light creates excitation regions 117, 118 indicated by solid circles in FIG. 2.

Further, the transmitting antenna 111 comprises a first and a second feedline 119*a*, 119*b* for supplying a voltage to the dipole section 113, each of the feedlines 119*a*, 119*b* connecting to an ending of the portions 1130, 1131 of the dipole section 113. The transmitting antenna 111 has an asymmetric design, wherein the feedlines 119*a*, 119*b* extend on the same side of the dipole section 113, wherein there is no feedline or feedline section extending on the other side of the dipole section 113 such that the transmitting antenna 111 has the shape of a "U" rather than the prior art "H"-shape.

The receiving antenna 112 comprises two feedlines 120*a*, 120*b* connecting to endings of the portions 1140, 1141 of the dipole section 114, wherein the feedlines 120*a*, 120*b* similarly to the feedlines 119*a*, 119*b* of the transmitting antenna 111 are arranged on one side of the dipole section 114, only. It is noted that the antennas 111, 112 do not necessarily have to have a perfect U-shape. Rather, the antennas may be optimized depending on their intended functions. For example, in the receiving antenna, the gap 116 of the dipole section may be designed in such a way that the light beam illuminates most of the gap. In a transmitting antenna, the photoconductive gap may be larger in order to permit higher voltages to be applied to the dipole section and to provide a longer acceleration path for the charger carriers.

The antennas 111, 112 are arranged in such a way that the feedlines 119*a*, 119*b* of the transmitting antenna 111 point in the opposite direction of the receiving antenna 12. Further, the antennas 111, 112 are arranged with an offset both in the vertical direction (the direction parallel to the feedlines) and in the horizontal direction (perpendicular to the feedlines) such that there is a considerable distance between the feedlines 119*a*, 119*b* of the transmitting antenna 111 and the feedlines 120*a*, 120*b* of the receiving transmitter 112, thereby reducing crosstalk between those feedlines and thus between the antennas 111, 112.

Figure 3:
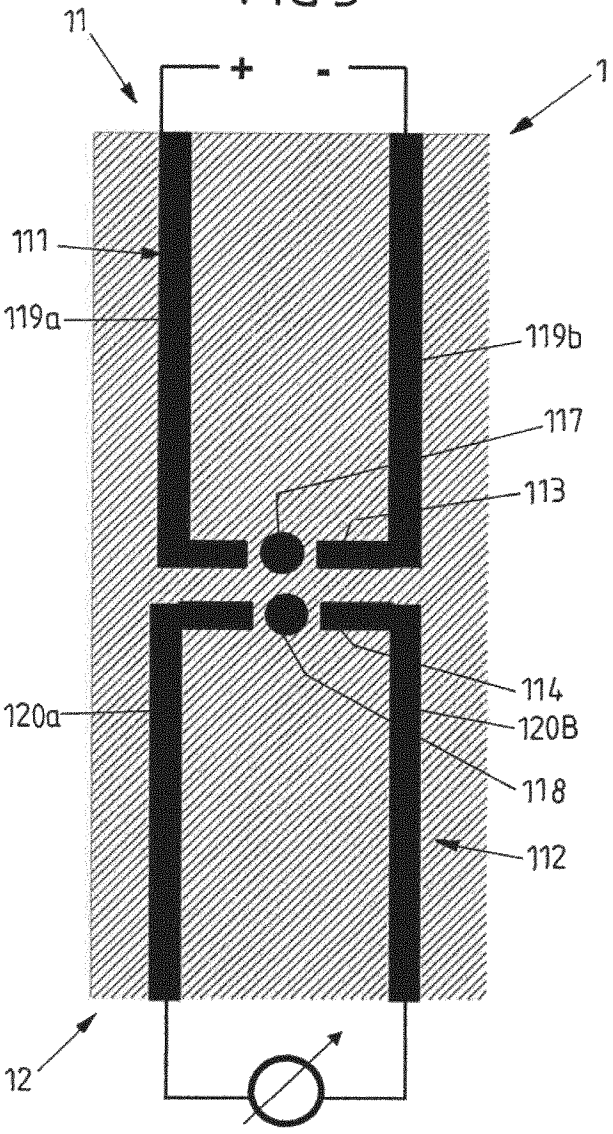
FIG. 3 a terahertz transceiver according to a second embodiment.

FIG. 3 shows another possible arrangement of the antennas 111, 112. According to that configuration, the antennas 111, 112 are arranged in a row in the vertical direction (i.e. in a direction parallel to the feedlines 119*a*, 119*b*, 120*a*, 120*b*), i.e. the antennas 111, 112 are arranged in such a way that there is no or at least only a small displacement between the antennas 111, 112 in the horizontal direction. For example, the antennas 111, 112 are arranged in such a way that the feedlines 119*a*, 119*b* of the transmitting antenna 111 are aligned with the feedlines 120*a*, 120*b* of the receiving antenna 112. Using that configuration the distance between the excitation regions 117, 118 can be greatly reduced such that the terahertz radiation may be radiated onto an object nearly perpendicular to the object (the angle between transmitted and reflected radiation being close to zero).

Figure 4:
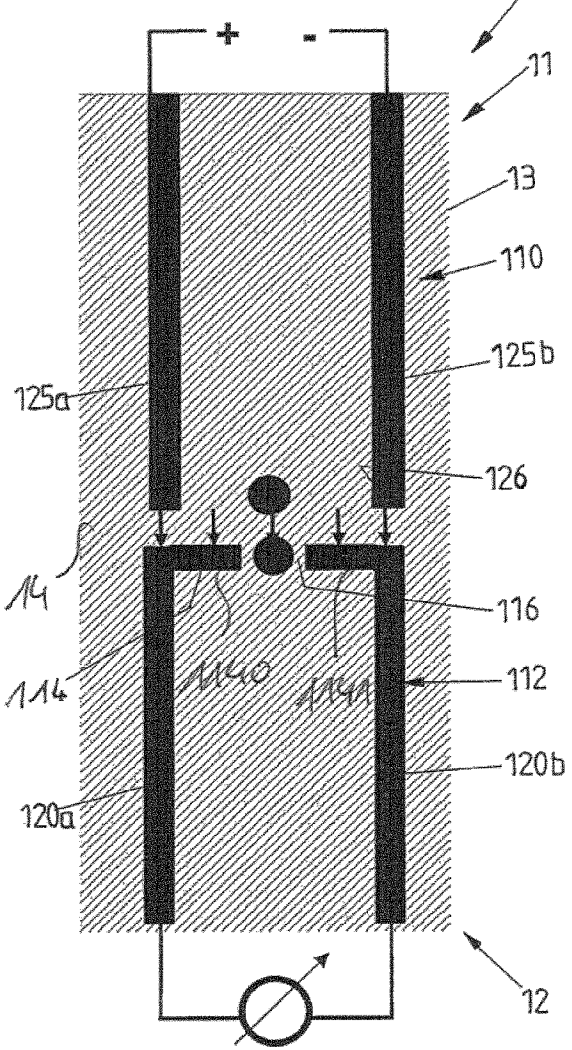
FIG. 4 a terahertz transceiver according to a third embodiment.

FIG. 4 illustrates a terahertz transceiver 1 according to yet another embodiment. According to FIG. 4, only the receiving antenna 112 is formed as a dipole antenna, i.e. an antenna comprising a dipole section 114 and feedlines 120*a*, 120*b* connected to the dipole section 114. The transmitting antenna, however, is a stripline antenna 110 having two parallel striplines 125*a*, 125*b* only, the striplines 125*a*, 125*b* delimiting an excitation region 126 (i.e. a gap between the striplines 125*a*, 125*b*). In particular, the antenna structure is formed by the two parallel striplines 125*a*, 125*b*, only. Similarly to FIGS. 1 to 3, the antennas 110, 112 are arranged on a common substrate 13, i.e. on a continuous photoconductor comprising photoconductive layers 14.

Further, the antennas 110, 112 are arranged directly above one another, i.e. there is no displacement of the antennas 110, 112 in the horizontal direction. However, it is of course possible that the antennas 110, 112 are at least slightly displaced also in the horizontal direction similarly to FIG. 2.

Figure 5:
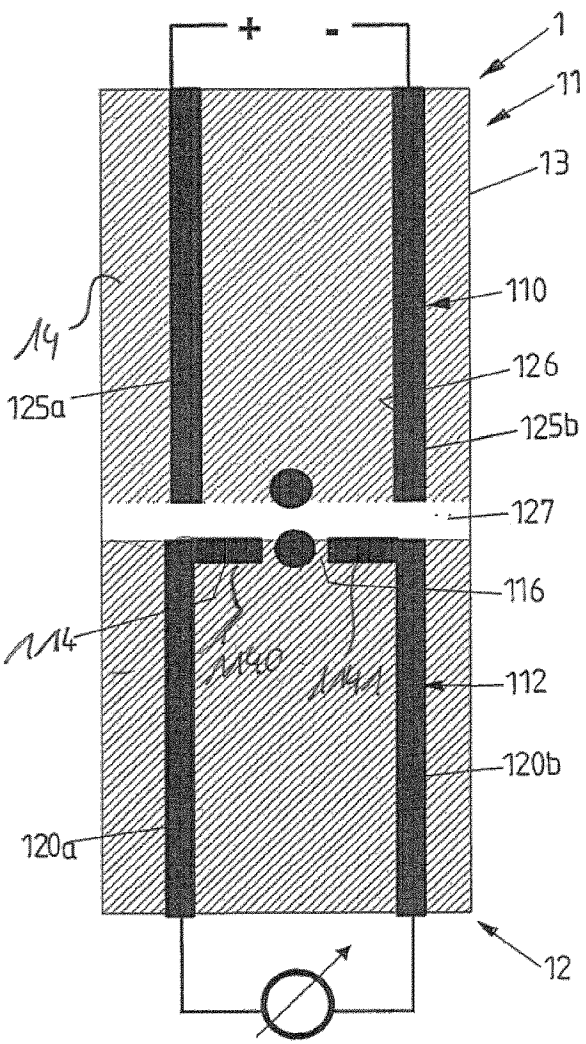
FIG. 5 a terahertz transceiver according to a fourth embodiment.

FIG. 5 illustrates a modification of FIG. 4, wherein the photoconductive layers 14 are removed between the antennas 110, 112 such that a trench 127 without the photoconductive layers 14 is formed between the antennas 110, 112, the trench 127 providing an electrical insulation between the antennas 110, 112. The substrate 13 may have a high resistance such that considerable currents via the substrate 13 will not occur. It is also possible that a larger region of the photoconductive layers 14 is removed. For example, the photoconductive layers 14 are maintained in the excitation regions 126, 116 of the antennas 110, 112, only, such that the excitation regions 126, 116 comprise photoconductive (e.g. strip like) mesa structures 128, 129 (cf. FIG. 6). According to FIG. 6, the striplines 125*a*, 125*b* laterally adjoin the photoconductive mesa structure 128 and the metallic portions 1140, 1141 of the dipole section 114 of the dipole antenna 12 adjoin the mesa structure 129.

Figure 6:
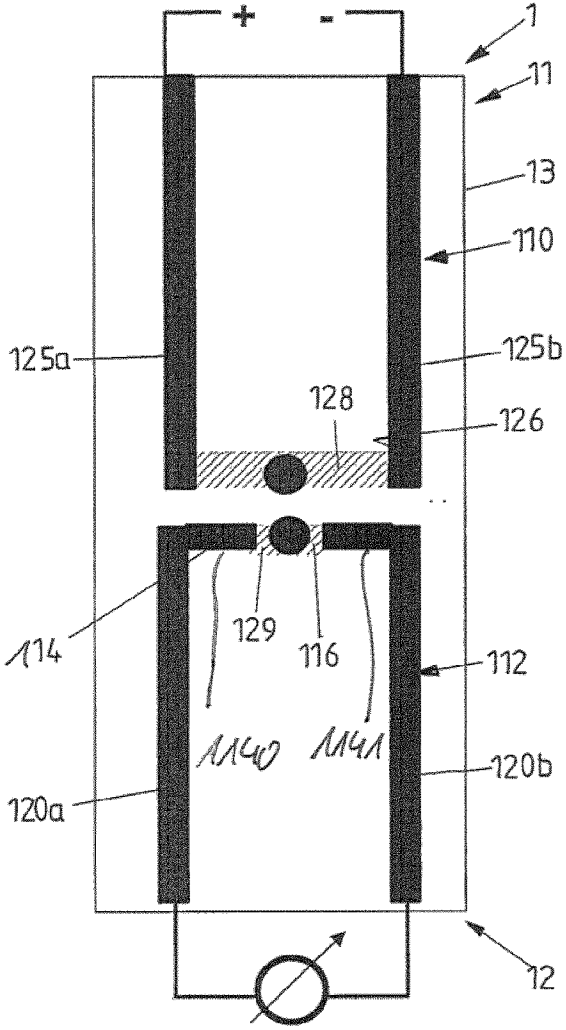
FIG. 6 a terahertz transceiver according to a sixth embodiment.

Of course, the embodiments of FIGS. 5 and 6 could also be realized by using two dipole antennas and/or by arranging the antennas with an additional horizontal offset.

Figure 7:
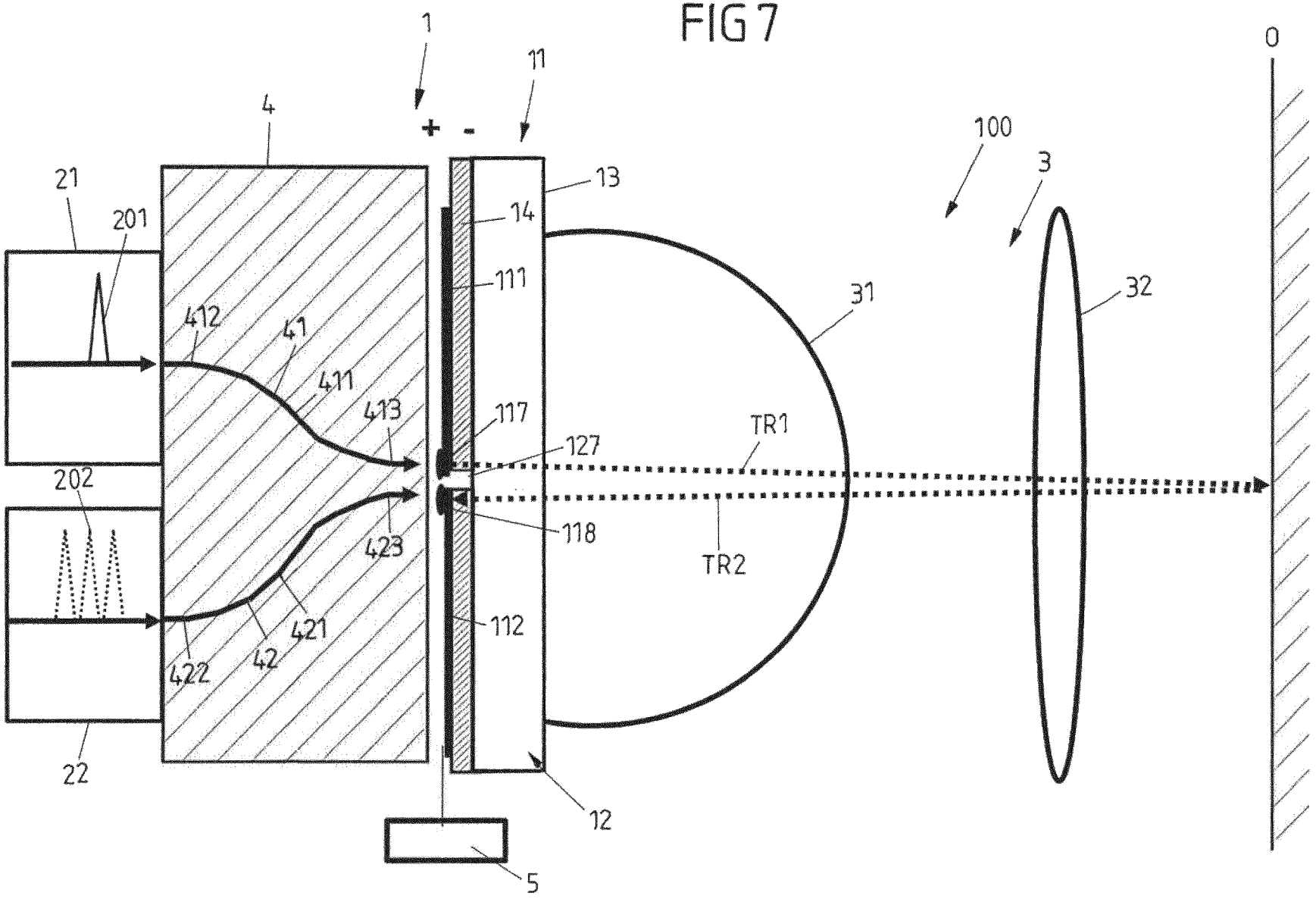
FIG. 7 schematically a terahertz transceiver arrangement comprising a terahertz transceiver according to an embodiment.

FIG. 7 schematically depicts a transceiver arrangement 100 comprising a transceiver 1 according to an embodiment. For example, transceiver 1 comprises elements of the transceivers shown in FIGS. 1 to 6. That is, the transceiver 1 comprises a transmitting and the receiving section 11, 12, the transmitting section 11 including a transmitting antenna 111 and the receiving section 12 including a receiving antenna 112. The antennas 111, 112 are arranged on photoconductive layers 14 disposed on a substrate 13.

The transceiver arrangement 100 further comprises a first and a second optical fiber 21, 22, wherein the first optical fiber 21 is configured and arranged for guiding light (e.g. in the form of light pulse 201 generated by a pulsed laser) towards the excitation region 117 of the transmitting antenna 111. The second optical fiber 22 is configured and used for guiding optical pulses 202 towards the excitation region 118 of the receiving antenna 112. The temporal position of the pulses 201 relative to the temporal position of the pulses 202 may be varied in order to scan the terahertz radiation detected using the receiving antenna 112. For example, the time position of the pulses 202 transmitted to the receiving antenna 112 is varied (indicated by the dashed pulse shape in FIG. 7).

The optical fibers 21, 22 are connected to a coupling element 4, wherein the coupling element 4 comprises a first and a second integrated optical waveguide 41, 42. The pulses 201 are coupled from the first optical fiber 21 into the first integrated optical waveguide 41, wherein the integrated optical waveguide 41 is formed in such a way that it guides the pulses 201 towards the excitation region 117 of the transmitting antenna 111. The second integrated optical waveguide 42 carries the light pulses 202 towards the excitation region 118 of the receiving antenna 112. For example, the optical fibers 21, 22 are connected to the coupling element 4, i.e. by means of an adhesive. Further, the first and the second integrated optical waveguide 41, 42 comprise inversely extending curvatures 411, 421 such that the distance between input endings 412, 422 of the integrated waveguides 41, 42 is larger than the distance between output endings 413, 423 in order to allow the optical fibers 21, 22 (e.g. having a diameter of at least 125 μm) to be connected to a front side of the coupling element 4. The coupling element 4 (e.g. a SOI or polymer chip) is aligned and fixed relative to the antenna chip (comprising the substrate 13, the photoconductive layers 14 and the antennas 111, 112). The transceiver 1 may be arranged in a protective housing (not shown).

Moreover, the transceiver arrangement 100 comprises an optical arrangement 3 having a first optical lens 31 arranged adjacent a backside (i.e. a side facing away from the antennas 111, 112) of substrate 13. The lens 31 may comprise or may consist of silicon. Further, the optical arrangement 3 may comprise terahertz optics represented in FIG. 7 by a lens 32. The terahertz optics instead or in addition to lens 32 may comprise other lenses, mirrors, etc. The optical arrangement 3 is used for radiating terahertz radiation TR1 emitted by the transmitting antenna 111 onto an object O and for radiating terahertz radiation TR2 reflected back from the object O towards the receiving antenna 112. The reflected terahertz radiation is directly detected by an evaluation unit 5 using an output signal of the receiving antenna 112 supplied to the evaluation unit 5. More particularly, the detection of the terahertz radiation may be performed without using the lock-in technique and thus without having to arrange a mechanical chopper in the beam paths of terahertz radiation TR1, TR2.

The invention claimed is:

1. A terahertz transceiver, comprising:

a photoconductive material;

at least a first and a second antenna each comprising an excitation region in which the photoconductive material is excitable by optical radiation, wherein the first and/or the second antenna is a dipole antenna comprising a dipole section;

wherein each dipole section has a gap through which light can be radiated onto the photoconductive material;

wherein a first ending of each dipole section is connected to a first feedline and a second ending of each dipole section is connected to a second feedline, the feedlines extending with an angle to each dipole section, and wherein:

(a) both the first and the second antenna are dipole antennas, wherein for each antenna a first section of at least one of the feedlines extending on one side of the dipole section is longer than a second section of the at least one feedline extending on the other side of the dipole section and/or at least one of the feedlines extends on one side of the dipole section, only, wherein the first and the second antenna are arranged in such a way that the longer section of the at least one feedline or the entire feedline of the first antenna is oriented in the opposite direction of the at least one feedline or of the entire feedline of the second antenna; or (b) one of the antennas is a stripline antenna consisting of two parallel striplines delimiting the excitation region, and the other antenna is the dipole antenna having an asymmetric design, wherein a first section of at least one of the feedlines extending on one side of the dipole section of the dipole antenna is longer than a second section of the at least one feedline extending on the other side of the dipole section and/or at least one of the feedlines extends on one side of the dipole section, only, wherein the striplines of the stripline antenna are parallel to the feedlines of the dipole antenna and are arranged on the other side of the dipole section of the dipole antenna than the first section of the at least one feedline or the entire feedline of the dipole antenna.

2. The terahertz transceiver as claimed in claim 1, wherein the length of the first section is at least twice, at least three times or at least five times the length of the second section of the at least one feedline.

3. The terahertz transceiver as claimed in claim 1, wherein the dipole section comprises a first and a second electrically conductive material portion adjoining the gap.

4. The terahertz transceiver as claimed in claim 1, wherein both the first and the second antenna has an asymmetric design, and wherein the first and the second antenna are arranged in such a way that the longer section of the at least one feedline or the entire feedline is orientated in the opposite direction of the longer section of the at least one feedline or of the entire feedline of the second antenna.

5. The terahertz transceiver as claimed in claim 1, wherein the first and the second antenna are offset relative to one another in a direction parallel to the feedlines.

6. The terahertz transceiver as claimed in claim 1, wherein the first and the second antenna at least partially are arranged in a row extending parallel to the feedlines.

7. The terahertz transceiver as claimed in claim 1, wherein the first and the second antenna are monolithically integrated on a common substrate.

8. The terahertz transceiver as claimed in claim 1, wherein the first and the second antenna are arranged at least partially on the photoconductive material and/or laterally adjoin the photoconductive material, wherein a region between the first and the second antenna is free of the photoconductive material.

9. The terahertz transceiver as claimed in claim 8, wherein the region forms an electrically insulating trench.

10. The terahertz transceiver as claimed in claim 1, wherein the excitation regions of the first and/or the second antenna comprises a photoconductive mesa structure.

11. The terahertz transceiver as claimed in claim 1, wherein one of the antennas is an asymmetric dipole antenna and the other antenna is a stripline antenna.

12. The terahertz transceiver arrangement as claimed in claim 11, further comprising an evaluating arrangement for evaluating signals of one of the antennas operated as a receiving antenna, wherein the evaluating arrangement is configured for evaluating the antenna signals without using the lock-in technique.

13. The terahertz transceiver as claimed in claim 1, further comprising an optical arrangement for both imaging THz radiation emitted by one of the antennas onto an object and for imaging THz radiation reflected at the object onto the other antenna.

14. A terahertz transceiver arrangement comprising a terahertz transceiver as claimed in claim 1 and a light source configured for generating light pulses or a continuous optical beat signal radiated onto the excitation regions of the first and second antenna.

* * * * *